US005185213A

United States Patent [19]

Fujita et al.

[11] Patent Number: 5,185,213

[45] Date of Patent: Feb. 9, 1993

[54] INK JET RECORDING SHEET

[75] Inventors: Seigoro Fujita, Nishinomiya; Yoichi Fukuzawa, Amagasaki, both of Japan

[73] Assignee: Kanzaki Papper Manufacturing Co., Ltd., Tokyo, Japan

[21] Appl. No.: 717,997

[22] Filed: Jun. 20, 1991

[30] Foreign Application Priority Data

Jun. 23, 1990 [JP] Japan ..... 2-165015

[51] Int. Cl.[5] ..... B41M 5/00

[52] U.S. Cl. ..... 428/500; 428/195; 428/206; 428/211; 428/330; 428/507

[58] Field of Search ..... 428/323, 195, 329, 330, 428/331, 206, 211, 507

[56] References Cited

U.S. PATENT DOCUMENTS 4,900,620 2/1990 Tokita et al. ..... 428/195

*Primary Examiner*—B. Hamilton Hess
*Assistant Examiner*—W. Krynski
*Attorney, Agent, or Firm*—Morgan & Finnegan

[57] ABSTRACT

An ink jet recording sheet comprises on a film substrate a coating layer which contains a pigment component and a binder component. The pigment component comprises prismatic orthorhombic aragonite calcium carbonate having an oil absorption of 30 to 55 ml/100 g in an amount of 20 to 70 weight %. The binder component comprises an epoxy resin and a thermoplastic resin.

9 Claims, No Drawings

INK JET RECORDING SHEET

BACKGROUND OF THE INVENTION

This invention relates to an ink jet recording sheet, particularly to a large size ink jet recording sheet which has a high water-resistance in a severe environmental condition, especially resistant to outdoor use and using an aqueous ink excellent in ink gloss, smoothness, ink absorption and dryability.

The ink jet recording process has been used in various printer for many applications as it is low in noise and can perform a high speed recording and multi-color recording.

Especially, the image formed by the multi-color ink jet recording process has been noticed as it compares favorably with the usual multi-color printing and it can be manufactured in lower cost than the usual multi-color photoengraving and the color photoprint process in the case of large poster in a small number of copies.

As to the recording sheet used in the multi-color ink jet recording process, the woodfree paper and the coated paper used in the general printing cannot be used in the application such as the poster for outdoor use as it has paper substrate and thus is weak to the humidity change and rain.

Baryta paper used as the substrate of the photoprint substrate contains an wet strength improver, etc. to enhance the water resistance but gelatin and casein, etc. used in the coating layer are low in water-resistance and so it is also unsuitable for outdoor use.

On these points, the synthetic paper is excellent in water resistance but inferior in ink absorption and thus, when it is used as the sheet for ink jet recording, the image is contaminated with residual ink. Especially in the case of multi-color recording, the ink amount is high as ink dots of 2 to 4 colors overlaps on the same spot and thus the inks are mixed before absorbed and floods out unfavorably to make the process impractical.

There bas been proposed the use of a coated sheet prepared by forming on a synthetic film a pigment coating layer which is generally used to make an ink jet recording sheet. For example, U. S. Pat. No.4,460,637 (Japanese Laid-Open Patent Publication No.110287 of 1983) discloses a method in which the uppermost layer is formed with use of pigments having a given particle size to obtain the pore radius distribution curve showing at least two peaks. On the other hande, U. S. Pat. No.4,900,620 (Japanese Laid-Open Patent Publication No.95092 of 1989) discloses the use of a secondary particle size silica having a high specific surface area as a white pigment comprised in the coating layer.

However, those methods are insufficient in both of ink gloss and ink smoothness and only gives a dull image compared to usual multi-color print. Furthermore, It provides poor color reproducibility to give necessarily no satisfactory result.

From these circumstance, we, inventors, have investigated on the elimination of the above disadvantages especially by aiming at an ink jet recording sheet prepared by forming a pigment coating layer on a film substrate and have found that, when calcium carbonate having a specific oil absorption and shape is used as the pigment constituting the pigment coating layer, ink gloss and smoothness in printing is effectively improved and especially, when an oil absorbing pigment of a specific oil absorption is used in combination with it, ink absorption and dryability can be easily controlled and especially calcined kaolin accomplishes these improvements in very high balance. Furthermore, when a specific resin is used in combination as the adhesive, it has been found that the water resistant strength and the adhesive strength can be improved with no deterioration of this balancing effect to complete the present invention.

SUMMARY OF THE INVENTION

An ink jet recording sheet according to the present invention has a coating layer containing a pigment component and a binder component on a film substrate. 20 to 70 weight % of the pigment component is a prismatic aragonite calcium carbonate having an oil absorption of 30 to 55 ml/100 g, and the binder component comprises an epoxy resin and a thermoplastic resin.

DETAILED DESCRIPTION OF THE INVENTION

The ink jet recording sheet of the present invention is suitable for large size ink jet recording. As the large size ink jet printer, for example there is available a multi-color enlarging printing equipment invented by Nippon Enlarging Color Co. Ltd. and manufactured by Matsushita Denso Kiki Co., Ltd.. This equipment contains a color separation control part and a recording part having a large drum of 1.5 m diameter and 3 m long. A recording sheet is wound on the drum and the solenoid valves of the aqueous ink spray guns for yellow, magenta, cyan and black equipped to the periphery of the drum are controlled to control the ink spraying amount for the recording. Though it requires a recording time of ca. 15 to 30 minutes to complete a large size image of 3×4 m, it can be used as the poster for outdoor advertisement as the image is large.

However, such an application requires quality characteristics different from general ink jet recording paper for office use. For example, weather resistance for outdoor use is required and especially water resistance against rain and wind is important. Whiteness, gloss, luster and smoothness of the sheet surface before recording are also important so that the finished print gets fully visual and excellent color characteristics. Ink gloss, luster and ink smoothness of the recorded image are also important.

We, inventors, have investigated on various quality requirements as above and have completed the invention comprising the above constitution by a proper selection of the composition and the shape of the pigment constituting the pigment coating layer and further the adhesive and the water-proofing agent.

And, the ink jet recording sheet of the present invention uses prismatic aragonite calcium carbonate having an oil absorption of 30 to 55 ml/100 g as the pigment constituting the pigment coating layer.

The calcium carbonate is a precipitated calcium carbonate and commercially available for example as various products in a trade name of Tamapearl from Okutama Kogyo Co., Ltd.. They include orthorhombic crystal having a specific gravity of 2.93, a Mohs' hardness of 3.5 to 4.0 and refractive indices of N× of 1.530, N, of 1.631 and N× of 1.685. According to the electromicroscopic observation, the length of the longer side (L) of the prismatic particle is 0.3 to 3 μm and the length of the shorter side (W) is 0.02 to 0.3 μm and thus the aspect ration (L/W) is ca. 2 to 20.

Furthermore, in the present invention, oil absorption of the calcium carbonate is also an important factor. An oil absorption of lower than 30 ml/100 g measured in accordance with JIS K-5101 lowers the ink smoothness of the recording sheet, while that of higher than 55 ml/100 g lowers the ink gloss. Hence, calcium carbonate having an oil absorption of 30 to 55 ml/100 g is used selectively. Calcium carbonate should be contained in the coating layer in an amount it account for 20 to 70 weight % of the total pigment mixture. An amount out of this range makes fine quality control of the recording sheet difficult to fail in the accomplishment of the desired effect of the present invention.

Fruther, in the recording sheet of the present invention, a combined use of of an oil absorbing pigment having an oil absorption of not lower than 80 ml/100 g, preferably 80–150 ml/100 g, such as calcined kaolin, magnesium carbonate, magnesium silicate, titanium oxide, zinc oxide, satin white, silicon oxide, alumina and plastic pigment, etc. in an amount 30 to 60 weight % based on the total amount of the pigment mixture together with such a specific calcium carbonate improves the quality balance of the resultant recording Sheet such as ink gloss, smoothness, ink absorption and ink dryability, etc.. Especially, when calcined kaolin having an oil absorption of 80 to 120 ml/100 g is used in combination, it Was found that the quality required for the large size ink jet recording sheet is improved in high efficiency.

Although the reason why such effect can be obtained is not clear, it can be assumed that the prismatic particles of calcium carbonate and the hexagonal plate particles of calcined kaolin are mutually dispersed and mixed to exert synergetic effect.

Further, the coating layer according to the present invention may comprise, in addition to the above specific aragonite calcium carbonate and the specific oil absorbing pigment, the other pigments generally used in a conventional coating composition. As the pigments, there are exemplified inorganic pigments such as precipitated calcium carbonate, ground limestone, kaolin, calcined kaolin, talc, calcium sulfate, barium sulfate, titanium oxide, zinc oxide, zinc sulfide, zinc carbonate, satin white, aluminum silicate, aluminum hydroxide, diatomaceous earth, magnesium silicate, alumina, lithopone and the like; and organic particles such as plastic pigments, microcapsules and the like.

In the ink jet recording sheet of the present invention, especially an epoxy resin and a thermoplastic resin are used in combination as the adhesives constituting the coating layer together with the above pigments. By the combined use of these adhesives, the water resistance and adhesive strength of the coating layer are maintained properly without deterioration in the balance effect such as excellent ink gloss and absorption obtained by the use of special pigment.

Although their mutual action by the combined use is not clear, the use of an epoxy resin alone gives a low adhesive strength, while a thermoplastic resin alone gives an insufficient water resistant strength.

The epoxy resin used in the present invention is a compound having not less than two reactive epoxy groups in the molecule and preferably used is a water-soluble epoxy compound prepared by glycidylating with use of epichlorohydrin.

Practically, the compounds which can be used include, for example, a di- or polyglycidyl ether of a glycol and of an aliphatic polyhydric alcohol, a diglycidyl ether of a dicarboxylic acid and an epoxy compound having nitrogen-containing hetero ring. They include, for example, ethylene glycol diglycidyl ether, diethylene glycol diglycidyl ether, triethylene glycol diglycidyl ether, polyethylene glycol diglycidyl ether ( n=5, 9, 13, 23, etc. ), propylene glycol diglycidyl ether, dipropylene glycol diglycidyl ether, polypropylene glycol diglycidyl ether ( n=3, 7, 11, etc. ), glycerol diglycidyl ether, glycerol triglycidyl ether, trimethylol propane triglycidyl ether, diglycerol polyglycidyl ether, sorbitol polyglycidyl ether, diglycidyl succinate, diglycidyl adipate, diglycidyl dimethyl hydantoin, glycidyl trimethyl ammonium chloride, furfuryl glycidyl ether, trimethylolethane triglycidyl ether, 3-methylpentanetriol triglycidyl ether, polyglycerol triglycidyl ether, glycerol ethylene oxide triglycidyl ether, etc.. Of course, at least two of them may be used in combination.

Among them, di- or polyglycidyl ethers obtained by glycidilaing glycols or aliphatic polyalcohols are preferably used.

The amount of epoxy resin as mentioned above is preferably controlled in the range of 1 to 40 parts by weight, more preferably 1 to 25 parts by weight, based on 100 part by weight of the pigment constituting the coating layer. An amount less than 1 part by weight is insufficient in the water resistance of the resultant coating layer, while an amount higher than 40 parts by weight of resultant color pigment is feared to lower the ink absorbility.

The thermoplastic resins which can be used in combination with the epoxy resin include, for example, conjugated diene copolymer latex such as styrene-butadiene binary or multicomponent copolymer latex and methyl methacrylate-butadiene binary or multicomponent copolymer latex; acrylic polymer latex such as (meth)acrylate polymer and copolymer; vinyl polymer latex such as ethylene-vinyl acetate copolymer; functional group-modified polymer latex prepared by introducing functional group to the above polymers or copolymers; and synthetic resin adhesives such as polymethyl methacrylate, polyurethane resin, unsaturated polyester resin, vinyl chloride-vinyl acetate copolymer, polyvinyl butyral, alkid resin, maleic anhydride resin and the like.

Among these thermoplastic resins, conjugated diene copolymer latexes such as styrene-butadiene binary or multicomponent copolymer latex and methylmethacrylate-butadiene binary or multicomponent copolymer latex are preferably used because they are excellent in the interaction with the epoxy resin used in combination. Especially the copolymer comprising 30 to 40% by weight of butadiene unit is most preferably used. Further, in the case of styrene-butadiene binary or multicomponent copolymer latex, it is preferably that the gel content of the copolymer is 30 to 85% by weight, particularly 40 to 70% by weight, because it is excellent in the improvement of water resistance, adhesive strength and ink absorption of the coating layer.

The amount of the thermoplastic resin used is properly controlled in accordance with the types of thermoplastic resin and epoxy resin used and generally in the range of 2 to 45 parts by weight, preferably 5 to 30 parts by weight based on 100 parts by weight of the pigment constituting the coating layer. Further, the used amount ratio of epoxy resin to thermoplastic resin is generally 0.3:30~4:1, preferably 1:30~3:1. When the total amount of the thermoplastic resin and epoxy resin exceeds 50 parts by weight, it is feared for the ink absorption to be lowered. So, the total amount is preferably determined taking it in consideration.

Although the interaction between the special pigment, epoxy resin and thermoplastic resin constituting the coating layer is not clear, it is assumed that epoxy group of the epoxy resin reacts efficiently with hydroxyl group, carboxyl group and carbonyl group of the thermoplastic resin in the presence of calcium carbonate and crosslink is formed by heating and drying the coating layer to give excellent water resistance and adhesive strength.

To the pigment coating composition for forming the coating layer, there may be added, if required, various auxiliary agents such as dispersing agent, thickener, fluidity modifier, antistatic agent, waterproofing agent, antifoaming agent, foam depressant, releasing agent, coloring agent, foaming agent and the like.

A film base substrate is used as the substrate constituting the ink jet recording sheet of the present invention. Practically, those which can be used include, for example, thermoplastic resin films such as polyester, polystyrene, polyvinyl chloride, polymethyl methacrylate, cellulose acetate, polyethlene, polypropylene and polycarbonate but are not restricted to them. The thermoplastic resin film is not restricted to transparent film but it may be opaque film containing filled white pigment such as titanium oxide, calcium carbonate, calcium sulfate, silica, clay, talc and zinc oxide or whitened by providing fine bubbles.

The film may be reinforced by laminating a waterproof material such as nonwoven fabric, woven fabric and the like. The thickness of the film or laminated material is generally controlled within the range of 10 to 2000 μm but is not restricted to the range.

The above-mentioned pigment coating composition is coated on the film surface of the film base substrate. As the coating machine, a usual coating machine such as a blade coater, an air knife coater, a roll coater, a brush coater, a curtain coater, a die coater, a bar coater, a gravure coater and a spray coater ma be used.

The coated amount of the pigment coating composition is generally controlled within the range of 2 to 60 $g/m^2$, preferably 5 to 40 $g/m^2$ on dry basis. Too small amount of the coating composition lowers ink absorption, while too large amount ot it lowers ink gloss.

An intermediate layer may be provided, if required, to enhance adhesion between the film base and the pigment coating layer.

In order to dry the pigment coating layer, there may be used various known methods, such as steam heating, hot air heating, gas heating, electric heating, infrared heating, high frequency-induction heating, laser heating, electronic ray heating and the like. It is preferred to control the surface temperature in accordance with the material of film base.

Although the recording sheet thus prepared by forming a coating layer on a substrate can be used as it is, the surface may be smoothened with a super calender or a gloss calender. However, excessive smoothening may affect adversely the characteristics such as ink absorption and accordingly it is preferable to control the treating conditions.

After forming a pigment coating layer on a surface of the above film and smoothening the coating layer, nonwoven fabric, woven fabric or the like is laminated on the other surface without the coating layer to make the film a strong sheet.

It is also possible to provide an adhesive on the back surface of the recording sheet to finish it as a so-called tack sheet. For the purpose, the application of the adhesive on the substrate can be made before the application of the pigment coating layer. Of course, various finishing and processing treatments used in the technical field can be also applied. For example, a surface treatment such as antistatic treatment and a treatment for giving writability (printablity) may be applied on the back surface of the sheet and auxiliaries such as an ultraviolet absorber and an antioxidant may be contained in optional site of the sheet to improve the retention of recorded images.

PREFERRED EMBODIMENTS OF THE INVENTION

The following examples serve to illustrate the invention in more detail although the invention is not limited to the examples. Unless otherwise indicated, part and % signify parts by weight and % by weight Further, butadiene content and gel content respectively show the butadiene unit content and the gel content in copolymers.

EXAMPLE 1

0.3 part of sodium polyacrylate was added to 50 parts of prismatic aragonite calcium carbonate having an oil absorption of 40 ml/100 g and an aspect ratio (L/W) of 8 and 50 parts of calcined kaolin (trade name: Ansirex, oil absorption: 110 ml/100 g, made by EMC Co., Ltd.) and dispersed with a stirrer to prepare a pigment slurry of 50% solid concentration.

To the pigment slurry, 4 parts of an epoxy resin (trade name: Denacol EX810, made by Nagase Sangyo Co., Ltd.), 20 parts of a styrene-butadiene copolymer latex (trade name: T-1242, made by Nippon Zeon Co., Ltd.) in which the butadiene content was 34% and the gel content was 54%, 3 parts of an antistatic agent and 4 parts of zirconium ammonium carbonate were added each on solid basis and water was added to prepare a pigment coating composition of 45% solid concentration.

The coating composition was applied on a surface of a polypropylene synthetic paper (trade name: Yupo FPG-150, made by Oji Yuka Co., Ltd.) in the weight of an amount of 20 $g/m^2$ on dry basis with use of a bar coater, and dried in a hot air dryer at 60° C. for 30 seconds to prepare an ink jet recording sheet.

EXAMPLE 2

An ink jet recording sheet was prepared in the same manner as in Example 1 except that prismatic aragonite calcium carbonate having an oil absorption of 55 ml/100 g and an aspect ratio (L/W) of 13 was used as the calcium carbonate.

EXAMPLE 3

An ink jet recording sheet was prepared in the same manner as in Example 1 except that prismatic aragonite calcium carbonate having an oil absorption of 32 ml/100 g and an aspect ratio (L/W) of 8 was used as the calcium carbonate.

COMPARATIVE EXAMPLE 1

An ink jet recording sheet was prepared in the same manner as in Example 1 except that prismatic aragonite calcium carbonate having an oil absorption of 25 ml/100 g and an aspect ratio (L/W) of 10 was used as the calcium carbonate.

EXAMPLE 4

An ink jet recording sheet was prepared in the same manner as in Example 1 except that the amounts of prismatic aragonite calcium carbonate and calcined kaolin were changed to respectively 65 and 35 parts.

EXAMPLE 5

An ink jet recording sheet was prepared in the same manner as in Example 1 except that the amounts of prismatic aragonite calcium carbonate and calcined kaolin were changed to respectively 30 and 70 parts.

EXAMPLE 6

An ink jet recording sheet was prepared in the same manner as in Example 1 except that calcined kaolin was replaced by fine powder alumina of an oil absorption of 105 ml/100 g (made by Mizusawa Kagaku Co., Ltd.).

EXAMPLE 7

A pigment coating composition was prepared in the same manner as in Example 1 except that 40 parts of prismatic aragonite calcium carbonate having an oil absorption of 40 ml/100 g and an aspect ratio (L/W) of 8, 40 parts of calcined kaolin (trade name: Ansirex, oil absorption: 110 ml/100 g, made by EMC Co., Ltd.) and 20 parts of tiatnium dioxide (trade name: FA-55W, oil absorption: 23 ml/100 g, made by Furukawa Kikai Kinzoku Co., Ltd.) were used as the pigments.

The coating composition was applied on a surface of a white foamed polyethylene terephthalate film (trade name: Daiya Foil W-900-E #100, made by Daiya Foil Co., Ltd.) in the weight of an amount of 25 g/m$^2$ on dry basis with use of a bar coater and dried in a hot air dryer at 60° C. for 30 seconds to prepare an ink jet recording sheet.

EXAMPLE 8

A pigment coating composition was prepared in the same manner as in Example 1 except that 50 parts of prismatic aragonite calcium carbonate having an oil absorption of 55 ml/100 g and an aspect ratio (L/W) of 13, 25 parts of calcined kaolin (trade name: Ansirex, oil absorption: 110 ml/100 g, made by EMC Co., Ltd.) and 25 parts of kaolin (trade name: UW-90, oil absorption: 40 ml/100 g, made by EMC Co., Ltd.) were used as the pigments.

The coating composition was applied on a surface of polyethylene terephthalate, which is laminated on a nonwoven fabric (trade name: Marix 70200 WSO, made by Unitika Ltd.) with a fuzed polyethylene, in the weight of an amount of 25 g/m$^2$ on dry basis with use of a bar coater and dried in a hot air dryer at 60° C. for 30 seconds to prepare an ink jet recording sheet.

COMPARATIVE EXAMPLE 2

An ink jet recording sheet was prepared in the same manner as in Example 1 except that the used amount of prismatic aragonite calcium was changed to 100 parts and calcined kaolin was not used.

COMPARATIVE EXAMPLE 3

An ink jet recording sheet was prepared in the same manner as in Example 1 except that the used amount of calcined kaolin was changed to 100 parts and calcium carbonate was not used.

COMPARATIVE EXAMPLE 4

An ink jet recording sheet was prepared in the same manner as in Example 1 except that spindle-shaped calcite calcium carbonate having an oil absorption of 47 ml/100 g was used instead of prismatic aragonite calcium carbonate.

EXAMPLE 19

An ink jet recording sheet was prepared in the same manner as in Example 1 except that the used amount of the epoxy resin (trade name: Denacol EX-810, made by Nagase & Company Ltd.) was changed to 20 parts.

COMPARATIVE EXAMPLE 5

An ink jet recording sheet was prepared in the same manner as in Example 1 except that the used amount of the epoxy resin (trade name: Denacol EX-810, made by Nagase & Company Ltd.) was changed to 0.5 parts.

EXAMPLE 10

An ink jet recording sheet was prepared in the same manner as in Example 1 except that a methylmethacrylate-butadiene copolymer latex (trade name: P-OX-55F, made by Sumitomo Naugatuck Co., Ltd.) in which the butadiene content was 31% was used instead of the styrene-butadiene copolymer latex.

EXAMPLE 11

An ink jet recording sheet was prepared in the same manner as in Example 1 except that a styrene-butadiene copolymer latex (trade name: L-1571, made by Asahi Kasei Co., Ltd.), in which the butadiene content was 41% and the gel content was 90%, was used instead of the styrene-butadiene copolymer latex.

EXAMPLE 12

An ink jet recording sheet was prepared in the same manner as in Example 1 except that an acrylic polymer latex (trade name: Acronal YJ-2741D, made by Mitsubishi Yuka Badische Co., Ltd.) was used instead of the styrene-butadiene copolymer latex.

COMPARATIVE EXAMPLE 6

0.5 part of sodium polyacrylate was added to 50 parts of prismatic aragonite calcium carbonate having an oil absorption of 40 ml/100 g and an aspect ratio (L/W) of 8 and 50 parts of super fine particle silica having an oil absorption of 150 ml/100 g (trade name: Mizukasil P527, made by Mizusawa Kagaku Co., Ltd.) and dispersed with a stirrer to prepare a pigment slurry of 40% solid concentration.

To the pigment slurry, an aqueous solution containing 15 parts of polyvinyl alcohol (trade name: PVA117, made by Kuraray Co., Ltd.) was added and diluted with water to prepare a pigment coating solution of 20% solid concentration.

The procedure of Example 1 was repeated except that this coating solution was used to prepare an ink jet recording sheet.

The characteristics of thus obtained 18 ink jet recording sheets were examined by the following methods. The results are shown in Table 1.

Water resistance

The sample was immersed in water for 24 hours and then the surface of the coated layer was rubbed by fingertip 10 times and the state of the coated layer was evaluated by the following criteria.

①: The coated layer was not fallen off and was very strong.

②: The coated layer was not fallen off but was somewhat slippy.

③: The coated layer was fallen off slightly but there was no problem in practical use.

④: The coated layer was fallen off to cause problem in practical use.

⑤: The coated layer was fallen off in large amount and was weak.

⑥: The coated layer Was fallen off by the first rubbing and was very weak.

Ink gloss

By using a large size ink jet multi-color enlarging printing equipment invented by Nippon Enlarging Color Co., Ltd., 4 aqueous ink colors of yellow, magenta, cyan and black were printed on the sample and dried. Then the ink gloss was measured by using Gloss meter GM-3D (made by Murakami Shikisai Kenkyusho) at an angle of 60°. A larger value means a higher gloss.

Ink smoothness

The same procedure as above was performed for printing and the ink smoothness (cmHg) was measured by using Smoothter smoothness meter (made by Toei Densi Kogyo Co., Ltd.). A smaller value means a higher smoothness.

Ink absorption time

The same procedure as above was performed for printing and the time (minutes) until the gloss of the surface becomes not changed by absorption of the aqueous ink on the surface of recording layer was measured.

TABLE 1

| | Water resistance | Ink gloss (%) | Ink smoothness (cmHg) | Ink absorption time (min.) |
|---|---|---|---|---|
| Example 1 | ① | 65 | 0.5 | 7 |
| Example 2 | ② | 60 | 0.3 | 5 |
| Example 3 | ② | 53 | 1.0 | 10 |
| Comp. Ex. 1 | ② | 35 | 3.0 | 20 |
| Example 4 | ② | 72 | 0.3 | 15 |
| Example 5 | ② | 50 | 1.2 | 5 |
| Example 6 | ② | 45 | 1.8 | 10 |
| Example 7 | ② | 63 | 0.3 | 18 |
| Example 8 | ② | 65 | 1.0 | 18 |
| Comp. Ex. 2 | ② | 80 | 0.2 | 30 |
| Comp. Ex. 3 | ② | 32 | 2.5 | 3 |
| Comp. Ex. 4 | ② | 20 | 3.0 | 25 |
| Example 9 | ① | 69 | 0.4 | 15 |
| Comp. Ex. 5 | ⑤ | 63 | 0.5 | 5 |
| Example 10 | ③ | 65 | 0.5 | 7 |
| Example 11 | ③ | 64 | 0.5 | 7 |
| Example 12 | ③ | 55 | 0.5 | 10 |
| Comp. Ex. 6 | ⑥ | 14 | 2.5 | 2 |

As apparent from the results in Table 1, the ink jet recording sheet of the invention had a high balance in the all estimations including water resistance, ink gloss, ink smoothness and ink absorption time and had excellent quality characteristics.

However, a low oil absorption of prismatic aragonite calcium carbonate (Comparative Example 1) lowered ink gloss, ink smoothness and ink dryability. An amount of aragonite calcium carbonate out of the specified amount lowered ink dryability (Comparative Example 2), ink gloss and ink smoothness (Comparative Example 3). Further, a low amount of the epoxy resin (Comparative Example 5) lowered water resistance and a binder composition different from the invention (Comparative Example 6) lowered extremely water resistance, ink gloss and ink smoothness

What is claimed is:

1. An ink jet recording sheet in which a coating layer containing a pigment component and a binder component is formed on a film substrate, characterized in that 20 to 70 weight % of said pigment component is prismatic aragonite calcium carbonate having an oil absorption of 30 to 55 ml/100 g, said binder component comprises an epoxy resin and a thermoplastic resin, the amount of said binder component is not more than 50 parts by weight based on 100 parts by weight of said pigment component.

2. An ink jet recording sheet according to claim 1, wherein 30 to 80 weight % of said pigment component consists of at least one oil absorbing pigment having an oil absorption of not lower than 80 ml/100 g.

3. An ink jet recording sheet according to claim 2, wherein said oil absorbing pigment has an oil absorption of 80 to 150 ml/100 g.

4. An ink jet recording sheet according to claim 2, wherein said oil absorbing pigment is a calcined kaolin having an oil absorption of 80 to 120 ml/100 g.

5. An ink jet recording sheet according to claim 1, wherein said epoxy resin is comprised in said coating layer in an amount of 1 to 25 parts by weight based on 100 parts by weight of said pigment component.

6. An ink jet recording sheet according to claim 1, wherein said thermoplastic resin is a conjugated-diene copolymer latex.

7. An ink jet recording sheet according to claim 6, wherein said conjugated-diene copolymer latex is selected from the group consisting of styrene-butadiene binary or multicomponent copolymer latexes and methylmethacrylate-butadiene binary or multicomponent copolymer latexes, and said copolymer comprises 30 to 40% by weight of butadiene unit.

8. An ink jet recording sheet according to claim 7, wherein the gel content of said styrene-butadiene binary or multicomponent copolymer is 30 to 85% by weight.

9. An ink jet recording sheet according to claim 1, wherein said thermoplastic resin is comprised in said coating layer in an amount of 2 to 45 parts by weight based on 100 parts by weight of said pigment component.

* * * * *